US007360767B2

(12) United States Patent
Merccica

(10) Patent No.: US 7,360,767 B2
(45) Date of Patent: Apr. 22, 2008

(54) APPARATUS FOR PLAYING A FLYING DISC GAME

(76) Inventor: Tony Merccica, 210 Thickson Road South, Whitby, Ontario (CA) L1N 2E1

( * ) Notice: Subject to any disclaimer, the term of this patent is extended or adjusted under 35 U.S.C. 154(b) by 84 days.

(21) Appl. No.: 11/280,401

(22) Filed: Nov. 17, 2005

(65) Prior Publication Data

US 2006/0103072 A1 May 18, 2006

Related U.S. Application Data

(60) Provisional application No. 60/628,531, filed on Nov. 18, 2005.

(51) Int. Cl.
*A63B 67/06* (2006.01)

(52) U.S. Cl. ..... 273/350; 273/393

(58) Field of Classification Search ..... 273/398–402, 273/348, 350, 387, 388, 383, 384, 393
See application file for complete search history.

(56) References Cited

U.S. PATENT DOCUMENTS

| | | | | |
|---|---|---|---|---|
| 1,649,740 | A * | 11/1927 | Rott | 273/393 |
| 2,520,392 | A * | 8/1950 | Flenghi | 273/393 |
| 3,469,844 | A * | 9/1969 | Sindelar | 273/350 |
| 3,862,758 | A * | 1/1975 | McLamb | 273/393 |
| 3,895,801 | A * | 7/1975 | Baird | 273/350 |
| 4,330,130 | A * | 5/1982 | Carr | 273/393 |
| 4,378,944 | A * | 4/1983 | Johnston | 273/393 |
| 5,421,585 | A * | 6/1995 | Ruvio | 273/338 |
| 6,173,957 | B1 * | 1/2001 | James, Sr. | 273/440 |
| 6,899,336 | B2 * | 5/2005 | Michelet et al. | 273/400 |
| 6,899,647 | B2 * | 5/2005 | Chia | 473/466 |

* cited by examiner

*Primary Examiner*—Mark S Graham
(74) *Attorney, Agent, or Firm*—Birch, Stewart, Kolasch & Birch, LLP

(57) ABSTRACT

The apparatus has a target which consists of two or more cylinders which rest on a support. The object of the game is to strike the cylinders with the flying disc from a distance so that they fall off the support. The cylinders are of unequal length such that striking the shorter disc by the flying disc when it is thrown a given distance requires greater skill than striking the longer cylinder when the disc is thrown the same distance. The support may be inflatable so that the game can be played in water.

14 Claims, 4 Drawing Sheets

APPARATUS FOR PLAYING A FLYING DISC GAME

This Nonprovisional application claims priority under 35 U.S.C. § 119(e) on U.S. Provisional Application No(s). 60/628,531 filed on Nov. 18, 2005, the entire contents of which are hereby incorporated by reference.

BACKGROUND OF THE INVENTION

This invention relates generally to apparatus for recreation and amusement, and particularly for apparatus for playing a throwing game.

Many types of games are known which are based on throwing a projectile at a target. Horseshoes and darts are well known examples of different apparatus that have been used for playing such throwing games. Many such games are primarily suited for playing in a particular environment, whether it be indoors, outdoors, on land or in the water. For example, the game of horseshoes is not well suited for indoor play as the throwing of horseshoes indoors is likely to lead to significant damage. Horseshoes is also not well suited for play in a swimming pool or lake. Not only would it be difficult for swimmers to throw horseshoes, it would be impractical to establish a stake to use as a target, whether fully submerged or extending above the surface of the water.

Moreover, notwithstanding that there are a number of known games which are based on throwing a projectile at a target, many individuals wish to try new games that present different challenges and require somewhat different skills.

It is thus an object of the present invention to provide a novel apparatus for playing a throwing game. It is also a particular objective of the present invention to provide apparatus for playing a throwing game which is adapted for different versions for play and different types of environments.

BRIEF SUMMARY OF THE INVENTION

In accordance with the present invention, there is provided an apparatus for playing a flying disc throwing game. The game includes at least one target, and at least one support upon which the cylindrical target can rest. Preferably the target is cylindrical and the support has a planar surface that is larger than the diameter of the cylinder and includes means for upholding the support with the planar surface oriented generally horizontally.

The target may be either solid or hollow. Its height and diameter are proportioned such that, in the case of a cylindrical target, it may rest in a meta-stable state on the planar surface, and such that it may be readily knocked down when it is hit by the flying disc that is thrown at it, but resists being knocked down accidentally due to ambient wind, ground vibration, and so forth. Due to its cylindrical shape, the target is susceptible to essentially the same knock down force from any direction. Thus, the target need not be carefully oriented when being placed, and players can arrange themselves in any direction without significant advantage.

The target may be made from a suitable material such as wood or plastic. Preferably, the target is cut from rigid plastic tubing but where buoyancy is desirable, the target may be moulded of solid closed cell foam.

In one version, the support includes an elongate member that is adapted to be inserted into a suitable ground site so as to hold the support securely with the planar surface generally horizontal. Preferably the member is sharpened at its free end and includes a plurality of connectable segments. Most preferably, the member is removably fixable to the support and is generally orthogonal to the planar surface.

According to an alternate version, the support includes a base, and bearing means interconnecting the base and the planar surface in spaced, parallel relationship. Preferably, the base and bearing means are generally pyramidal. In one embodiment, the base and bearing means comprise rigid members. In an alternate embodiment, the base and bearing means are inflatable. Preferably, such embodiment of the invention further comprises an angular wall extending up from the planar surface defining a recess adapted to receive the cylindrical target. Advantageously, the apparatus includes three cylindrical targets having the same diameter but different lengths. More advantageously, the apparatus includes at least two supports and at least two sets of three cylindrical targets. Most advantageously, the apparatus also includes at least one flying disc.

BRIEF DESCRIPTION OF THE DRAWINGS

In order that the invention may be more clearly understood, reference will be made to the accompanying drawings which illustrate preferred embodiments of the present invention, and in which.

DETAILED DESCRIPTION OF THE INVENTION

Figure 1:
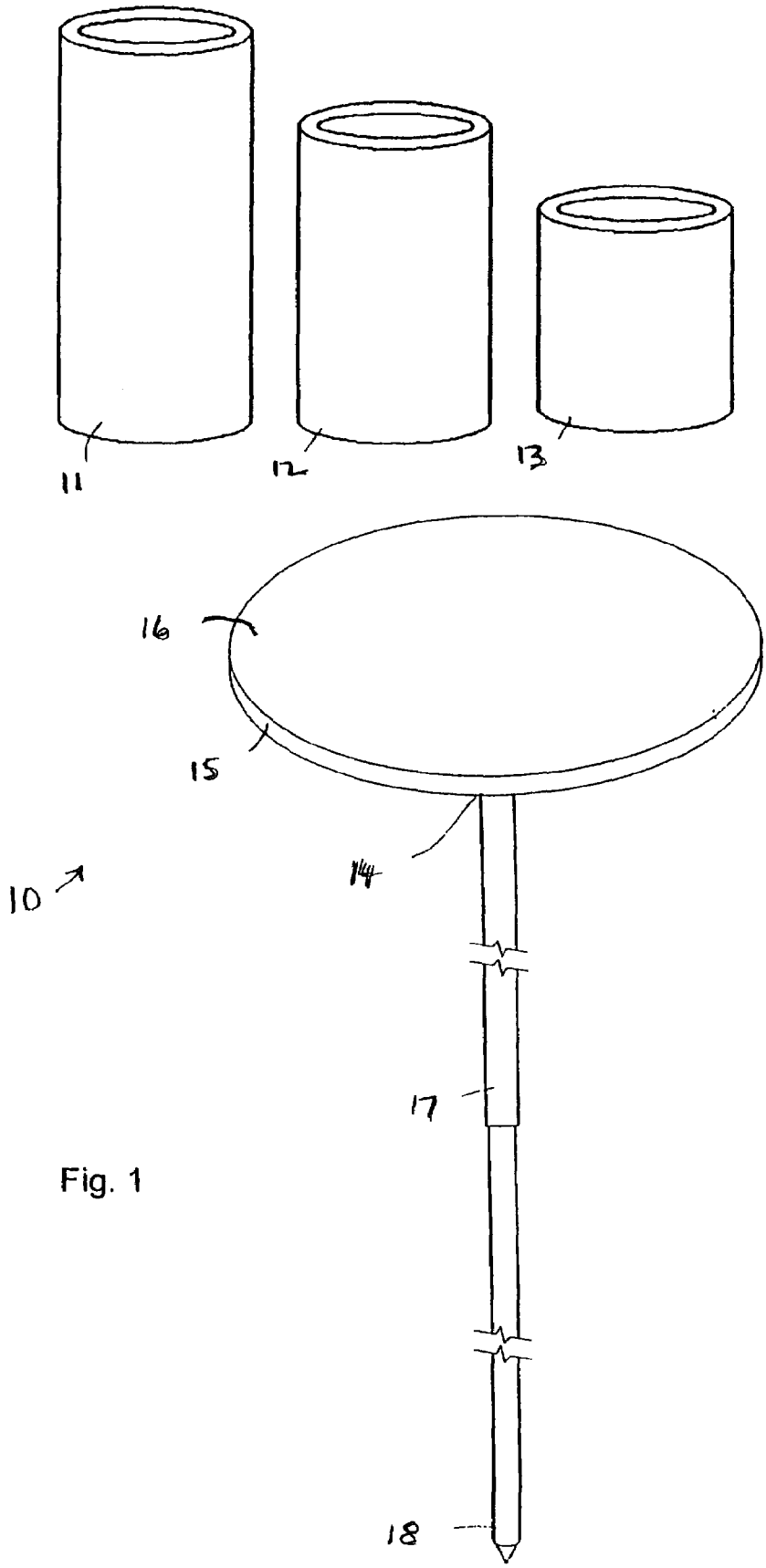
FIG. 1 is a schematic illustration of an apparatus for playing a flying disc throwing game according to a first embodiment of the present invention.

In the drawings, the game apparatus is denoted generally by reference number 10. In referring to the various figures, like numerals are used for like parts.

Turning first to FIG. 1, the game apparatus 10 includes a target consisting of three objects in the form of cylinders 11, 12, and 13. Each of the cylinders has an outside diameter of approximately 2 inches, with an inside diameter of approximately 1¾ inches, with a wall thickness of approximately ⅛ inches. The cylinders can be made of any suitable material, but are preferably made of plastic.

The largest cylinder 11 has a height of approximately 4 inches. The intermediate cylinder 12 has a height of approximately 3 inches and the smallest cylinder has a height of approximately 2 inches.

A support 14 includes a base in the form of a plate 15, approximately 5 inches in diameter, defining a planar surface 16. A leg or rod 17, approximately 18 inches in length, extends outwardly from plate 15 opposite the planar surface 16. The rod is sharpened at its free end 18. Preferably, the rod comprises segments that can be connected together by means of a friction fit or threaded cup links. The rod 17 may also be removably fixable to the plate 16 by means of a friction fit or threaded cup link.

In use, the rod 17 is assembled and affixed to the plate 15 and the support 14 is inserted into a suitable ground site such as a playground or open field, the rod 17 being pointed at its free end 18 to facilitate insertion into the ground. The support 14 is thereby held in the ground and is oriented such that the planar surface 16 is generally horizontal.

Before play begins, the largest cylinder 11 is placed on the planar surface 16. One or more players then throw a saucer shaped flying disc at the cylinder from a suitable distance in an attempt to knock it down. If the attempt is unsuccessful, another attempt is made. This is repeated until the attempt is successful.

Once cylinder 11 has been knocked down, it is replaced with intermediate cylinder 12. When that has been successfully knocked down, it is replaced with the smallest cylinder 13. Because each of the cylinders 11, 12, 13 is of a different height, successfully throwing the flying disc to knock each down requires greater skill and accuracy in each successive stage of the game.

Figure 2:
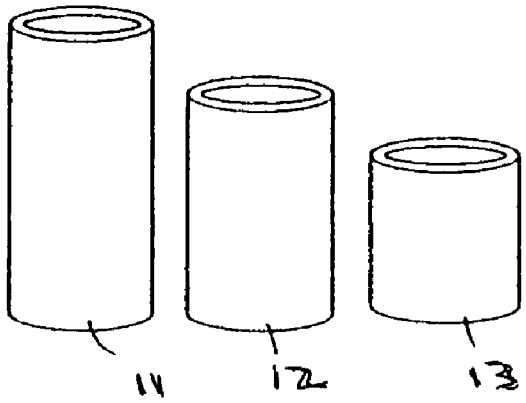
FIG. 2 is a schematic illustration of an apparatus for playing a flying disc throwing game according to a second embodiment of the present invention.
Figure 2:
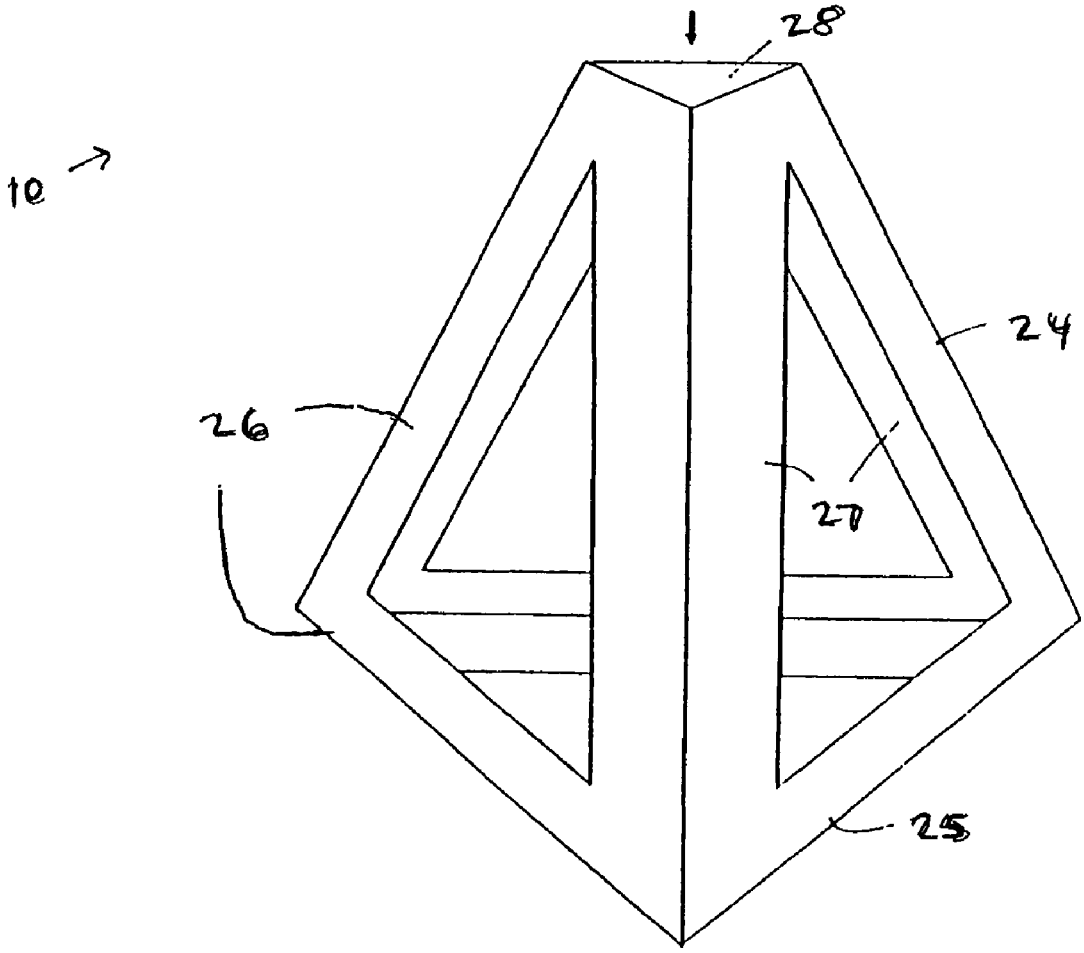

Turning to FIG. 2, an alternate embodiment is illustrated. In this version of the game, the cylindrical targets 11, 12, 13 are the same as in the first embodiments. However, support 24 consists of a generally frusto-tetrahedral structure having a triangular lower wall 25 and an upstanding framework 26. The framework extends to a truncated apex defining a planar surface 28. The lower wall 25 is adapted to be positioned and rest upon the ground or some other generally horizontal surface and defines a plane that is generally parallel to the planar surface 28.

In use, the support 24 is placed in a suitable position, whether outdoors or indoors, with the lower wall resting on the ground, or a floor or other suitable generally horizontal surface. The game to be played with this embodiment of the invention is otherwise similar to that described above.

Figure 1A:
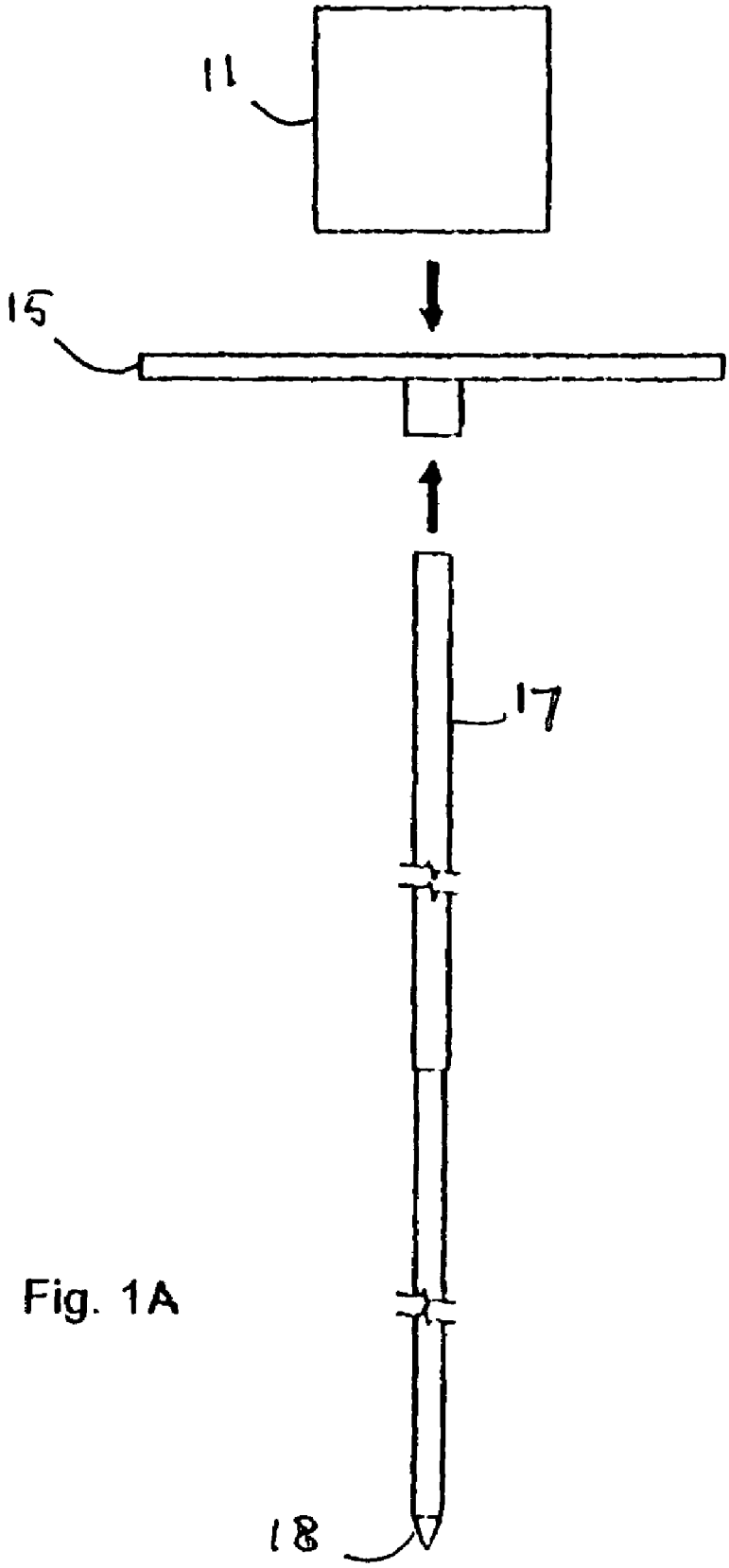
FIG. 1A is an elevation of the apparatus illustrated in FIG. 1.
Figure 3:
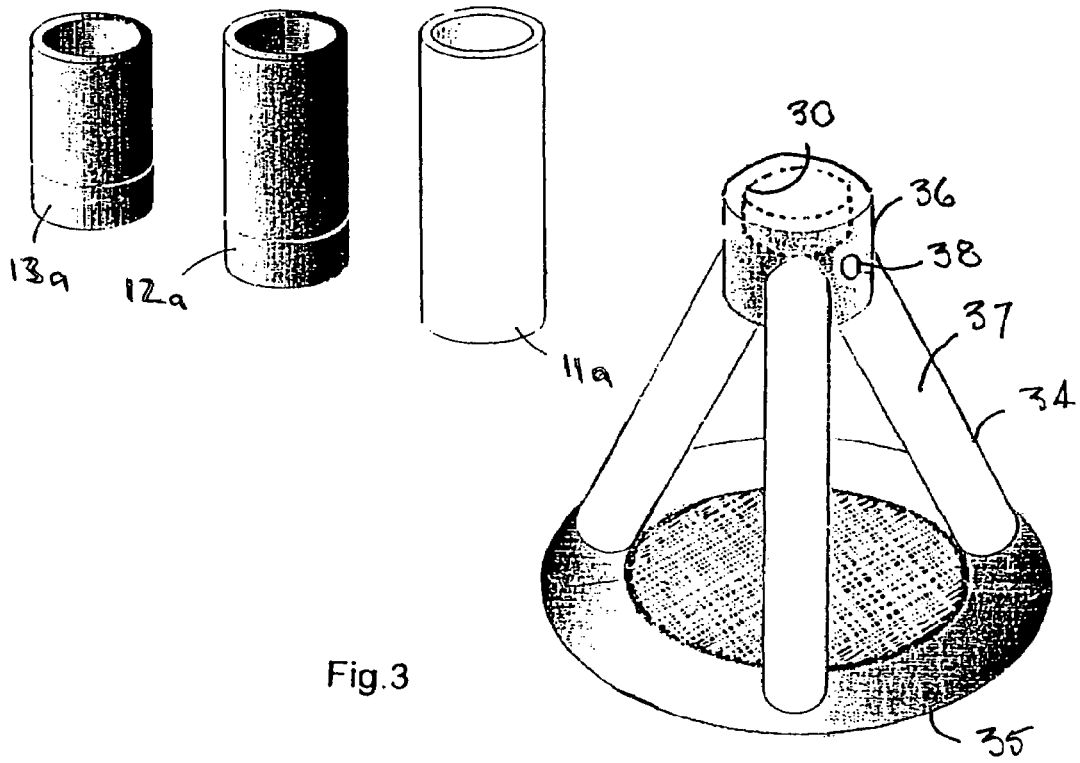
FIG. 3 is a schematic illustration of an apparatus for playing a flying disc throwing game according to a third embodiment of the present invention.

Turning to FIG. 3, this embodiment of the game apparatus again includes three cylinders 11*a*, 12*a*, and 13*a* which are similar to the cylinders 11, 12, 13 of the embodiments shown in FIGS. 1, 1A and 2, except that the length of each is extended approximately ¾ of an inch, as will be explained in greater detail below.

The support 34 includes a lower ring 35, a receptacle 36, and legs 37, all of which are inflatable. An air valve 38 is included to allow air to be introduced or exhausted from the support The lower ring 35, receptacle 36 and legs 37 are in liquid-flow communication with each other such that when air under pressure is introduced into the support, each of the lower ring 35, receptacle 36, and legs 37 is thereby inflated.

The lower ring 35 has an overall diameter of approximately 16 inches and is approximately 2 inches in diameter. Each of the legs 37 is approximately 1½ inches in diameter. The receptacle 36 has an outer diameter of approximately 3½ inches and a height of approximately 3 inches. The overall height of the support 34 is approximately 15½ inches.

Support 34 is intended to be used in an aquatic environment, such as a swimming pool or lake. When the support is inflated, its buoyancy causes it to float, with the lower ring 35 resting on the surface of the water, and the legs 37 and receptacle 36 extending above the surface. Preferably, the lower ring 35 also includes a central membrane 39 extending across it to seal the inner portion of the ring and thereby aid in flotation.

Figure 3A:
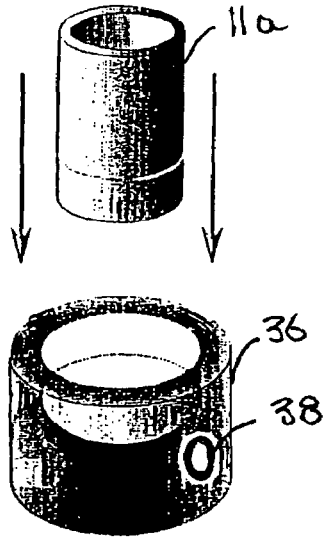
FIG. 3A is an enlarged perspective view of the receptacle and cylinder illustrated in FIG. 3.

With reference to FIGS. 3 and 3A, receptacle 36 includes a cylindrical recess 30 generally concentric to the receptacle 36. The recess has a diameter of approximately 2¾ inches and a depth of approximately ¾ inches. The cylinders 11*a*, 12*a*, 13*a* can each be seated within the recess 30. The inner wall which defines the recess provide a backing to prevent the cylinders from falling over too easily due to the movement of the support 34 on the surface of the water.

The game to be played with this embodiment of the invention is otherwise similar to that of the embodiments described above with the advantage that it may be played by individuals either positioned on land adjacent to water, or in the water.

The present invention thus provides a novel apparatus for playing a throwing game, particularly a flying disc throwing game. The game of the present invention moreover has embodiments that are suitable for playing in different environments, including indoors, outdoors, and in the water.

It will of course be appreciated that many additional variations are possible within the broad scope of the present invention. Those skilled in the art will appreciate that the invention upon which the description is based may be utilized in other embodiments that carry out the purposes and fulfill the objects of the present invention. The above disclosure is intended to be illustrative while the scope of the invention is defined by the following claims.

I claim:

1. In combination: a flying disc; and a target including at least two objects each adapted to be knocked over when struck by said flying disc, one said object being larger than the other said object such that striking the latter said object by said flying disc thrown a given distance requires greater skill than striking the former said object by said flying disc thrown the same said distance, further including a support on which each said object is adapted to rest, wherein said support includes a buoyant base adapted to float on the surface of a body of water, a receptacle and a plurality of legs which extend between said base and said receptacle for maintaining said receptacle spaced above said water surface, said receptacle adapted to receive a selective one of said objects but to allow whichever of said object is received therein to separate from said receptacle when struck by said flying disc.

2. The combination of claim 1 wherein said receptacle and said legs are buoyant and are in liquid flow communication with said base.

3. The combination of claim 1 wherein each said object is cylindrical.

4. The combination of claim 1 wherein each said object has the same outer diameter as the other said object but has a length which is different from the length of the other said object.

5. The combination of claim 1 wherein each said object is cylindrical and said support has a planar surface on which said objects are adapted to rest.

6. The combination of claim 5 wherein said planar surface is adapted to be oriented generally horizontally.

7. The combination of claim 6 wherein said receptacle extends upwardly from said planar surface and has an inner cylindrical wall which defines an opening in which a selective one of said objects is adapted to be received.

8. An apparatus for playing a game with a flying disc including: a target including at least two objects each adapted to be knocked over when struck by said flying disc, one said object being larger than the other said object such that striking the latter said object by said flying disc thrown a given distance requires greater skill than striking the former said object by said flying disc thrown the same distance; and a support on which each said object is adapted to rests, wherein said support includes a buoyant base adapted to float on the surface of a body of water, a receptacle and at least one leg which extends between said base and said receptacle for maintaining said receptacle spaced above said water surface, said receptacle being adapted to receive a selective one of said objects but to allow whichever of said object is received therein to separate from said receptacle when struck by said flying disc.

9. The apparatus of claim 8 wherein said receptacle and said legs are buoyant and are in liquid flow communication with said base.

10. The apparatus of claim 8 wherein each said object is cylindrical.

11. The apparatus of claim 8 wherein each said object has the same outer diameter as the other said object but has a length which is different from the length of the other said object.

12. The apparatus of claim 8 wherein each said object is cylindrical and said support has a planar surface on which said objects are adapted to rest.

13. The apparatus of claim 12 wherein said planar surface is adapted to be oriented generally horizontally.

14. The apparatus of claim 13 wherein said receptacle extends upwardly from said planar surface and has an inner cylindrical wall which defines an opening in which a selective one of said objects is adapted to be received.

* * * * *